US007896990B1

(12) United States Patent
Baker et al.

(10) Patent No.: US 7,896,990 B1
(45) Date of Patent: Mar. 1, 2011

(54) BURN RATE NANOTUBE MODIFIERS

(75) Inventors: James J. Baker, Waldorf, MD (US); John R. Luense, Accokeek, MD (US); Randall J. Cramer, Arlington, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1080 days.

(21) Appl. No.: 11/268,393

(22) Filed: Nov. 2, 2005

Related U.S. Application Data

(62) Division of application No. 10/782,001, filed on Feb. 20, 2004, now abandoned.

(51) Int. Cl.
*D03D 23/00* (2006.01)
*C06B 45/10* (2006.01)

(52) U.S. Cl. ..... 149/109.6; 149/19.92

(58) Field of Classification Search ..... 149/92, 149/109.6, 19.92
See application file for complete search history.

(56) References Cited

U.S. PATENT DOCUMENTS

| | | | | |
|---|---|---|---|---|
| 3,812,785 | A | 5/1974 | Cohen | 102/100 |
| 4,094,248 | A | 6/1978 | Jacobson | 102/100 |
| 4,386,569 | A | 6/1983 | Deas | 102/292 |
| 4,466,352 | A | 8/1984 | Dalet et al. | 102/288 |
| 4,581,998 | A | 4/1986 | Horst, Jr. et al. | 102/289 |
| 4,627,352 | A | 12/1986 | Brachert et al. | 102/290 |
| 4,758,287 | A | 7/1988 | Pietz | 149/2 |
| 4,911,077 | A | 3/1990 | Johansson et al. | 102/289 |
| 4,952,341 | A | 8/1990 | Sayles | 264/3.1 |
| 5,011,566 | A | 4/1991 | Hoffman | 156/643 |
| 5,090,322 | A | 2/1992 | Allford | 102/202.7 |
| 5,251,549 | A | 10/1993 | Boisseau et al. | 102/289 |
| 5,352,512 | A | 10/1994 | Hoffman | 428/311.5 |
| 5,505,799 | A | 4/1996 | Makowiecki | 149/15 |
| 5,747,161 | A | 5/1998 | Iijima | 428/367 |
| 6,113,722 | A | 9/2000 | Hoffman | 156/155 |
| 6,194,066 | B1 | 2/2001 | Hoffman | 428/367 |
| 6,444,062 | B2 | 9/2002 | O'Meara et al. | 149/109.6 |
| 7,025,840 | B1 * | 4/2006 | Adams | 149/108.2 |
| 2004/0040637 | A1 * | 3/2004 | Desilets et al. | 149/108.2 |

OTHER PUBLICATIONS

M. Steinhart et al., "Polymer Nanotubes by Wetting of Ordered Porous Templates", Science, 296, Jun. 14, 2002, p. 1997.

* cited by examiner

*Primary Examiner*—Aileen Felton
(74) *Attorney, Agent, or Firm*—Fredric J. Zimmerman

(57) ABSTRACT

Nanotubular structures of high energy materials are used in high energy compositions, such as propellants.

6 Claims, No Drawings

BURN RATE NANOTUBE MODIFIERS

The present Application is a Divisional Application of U.S. patent application Ser. No. 10/782,001 filed on Feb. 20, 2004 now abandoned.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

Nanotubular structures of high energy materials are used in propellent high energy compositions.

2. Brief Description of the Related Art

Problematic with high burn rate propellents are increased hazard sensitivity. Use of catalysts such as ferrocane, catocene, small metallic particles, small oxidizer particles and other modifiers has resulted in extremely sensitive materials prone to accidental initiation. Generally, accidental detonation of energetic compositions that incorporate a modifier results in greater damage than detonation of energetic compositions without the modifiers.

Propellants incorporating various physical configurations placed into the propellant have been disclosed, including openings (U.S. Pat. No. 3,812,785 to Cohen), perforations or grooves (U.S. Pat. No. 4,094,248 to Jacobson, U.S. Pat. No. 4,386,569 to Deas and U.S. Pat. No. 6,444,062 to O=Meara et al.), channels (U.S. Pat. No. 4,466,352 to Dalet et al.), slits (U.S. Pat. No. 4,581,998 to Horst, Jr. et al.), cavities (U.S. Pat. No. 4,627,352 to Brachert et al.), wormholed (U.S. Pat. No. 4,758,287 to Pietz), plastic tubing (U.S. Pat. No. 4,952,341 to Sayles), and combinations of the perforations and channels (U.S. Pat. No. 5,251,549 to Boisseau et al.). Configurations of the propellant have included single- or multi-holed tubular propellant rods (U.S. Pat. No. 4,911,077 to Johansson et al.) and deposited films (U.S. Pat. No. 5,090,322 to Allford).

Nanoengineered explosives having very thin submicron layers of a multilayer structure have been disclosed in U.S. Pat. No. 5,505,799 to Makowiecki.

Graphite filaments of helical structure with carbon hexagons in a tubular shape with an outer diameter of 30 nm or less useful with high-temperature heating elements has been disclosed in U.S. Pat. No. 5,747,161 to Iijima.

Lacking from these disclosures is a modifier for energetic compositions that incorporates energetic material therein for high burn rate propellants. As such, there is a need in the art to provide improved modifiers for energetic compositions. The present invention addresses this and other needs.

SUMMARY OF THE INVENTION

The present invention includes an energetic composition comprising a high energy material and one or more nanotubular structures comprising the high energy material. The energetic composition is preferably used as a burn rate modifier in a solid propellant such as for rocket motors.

The present invention also includes a process for producing a burn rate modifier comprising the steps of providing a chemical composition selected from the group consisting of inert material, low energy material and high energy material, forming nanotubular structures with the chemical composition and incorporating the nanotubular structures into an energetic composition.

DETAILED DESCRIPTION OF THE PREFERRED EMBODIMENT

The present invention includes an energetic composition having one or more nanotubular structures incorporated into the energetic composition with the nanotubular structures composed of high energy material. These energetic compositions are particularly useful in solid rocket propellants for their enhanced burn rate, improved resistance to hazards and improved performance characteristics.

High energy materials of the present invention includes energetic material, such as those compositions useful for explosives, pyrotechnics, detonators, etc., with representative high energy materials preferably including explosive compositions of trinitrotoluene (TNT), pentaerythritol tetranitrate (PETN), cyclo-trimethylene trinitramine (RDX), cyclotetramethylene tetranitramine (HMX), pentolite (a mixture of PETN and TNT), CL-20 (2,4,6,8,10,12-hexanitro-2,4,6,8,10,12-hexaazatetracyclo [5.5.0.0$^{5,9}$. 0$^{3,11}$]-dodecane and 2,4,6,8,10,12-hexanitrohexaazaisowurtzitane), and other types of solid explosives such as fuel-oxidizer mixtures, and various mixtures of these explosives. Preferred explosives include RDX, TNT, HMX and combinations thereof, with high energy materials of HMX or RDX most preferred. Classes of preferred high energy materials include soluble and melt processible energetic materials.

The high energy materials are incorporated into nanotubular structures for incorporation into propellant compositions. The nanotubes, used within the propellant, are produced with optimized diameter and length characteristics. Such nanotubular structures include any appropriate diameter and length for given burn rate characteristics as detailed herein, with representative nanotubular sizes including diameters of from about 5 micrometers to about 1000 micrometers, more preferably from about 50 micrometers to about 500 micrometers, and most preferably from about 50 to about 100 micrometers. Such characteristics include diameters large enough for the rocket motor to burn at a pressure above the Akick off@ point of the nanotubes used, and small enough to curtail a Akick off@ point that is too low as to cause problems in sensitivity testing. As a certain pressure needs to be obtained before a flame penetrates an opening in the propellant, the exact pressure is affected by the diameter of the opening. The smaller the opening, the higher the pressure required for the flame to enter that opening, i.e., the kick off pressure is higher for the smaller opening. Once the flame enters the opening, the amount of surface area that is burning increases relative to the surface area of the opening. This results in an apparent increase in the propellant burn rate, as more propellant is burned per unit time. The pressure required for the flame to enter an opening of a given diameter is referred to as the Akick off@ pressure. As such, the opening within the energetic nanotube is sized so that the kick off pressure is the desired rocket motor burn pressure. The nanotubular structures may include lengths the partially or fully extend the length of a propellant charge including, for example without limitation, about 0.05, 0.1, 0.5, 1, 2, 5, 10, 20, 50, 100 centimeters, and the like, with the proper length determinable by one skilled in the art in light of the disclosure herein as appropriate for a given propellant charge.

The burn rate modifier of the present invention incorporates nanotubular structures for increased Isp of the energetic composition. Specific Impulse (Isp) measures the performance for a rocket propellant system as the amount of thrust generated over the propellant mass consumed per unit time. Energetic materials, such as RDX and HMX, have Isp values higher than most solid propellants. However, incorporating too much of the energetic material into the propellant renders the propellant significantly more sensitive to accidental initiation. In addition to adding to the overall Isp of the propellant, nanotubes made of energetic material increase the burn rate beyond that expected just for the incorporation of particles of the same energetic material.

Preferably numerous (a plurality of) the nanotubular structures are incorporated into the energetic composition of the propellant system (charge). Once placed in the propellant, the nanotubular structures act as a burn rate modifier to the propellant during burn. The nanotubular structures may be configured, as needed, within the propellant to modify the burn of the solid propellant. When incorporated into the propellant, a substantial amount of the nanotubular structures may be longitudinally aligned, preferably with the nanotubular structures aligned along a direction of increased burn rate of the propellant. Additional burn rate modifiers, and other such components may be incorporated into the energetic compositions. Propellants, containing burn rate modifier nanotubular structures, are particularly useful in solid propellant rocket motors, and the like.

The energetic compositions of the present invention preferably include addition components for moderating the propellant burn, such as a temperature lowering component. Temperature lowering components may include, for example without limitation, mixtures of energetic materials that lower the melting point of one or more of the individual energetic materials for ease of processing, preferably as a eutectic mixture, temperature lowering plasticizers or solvents, combinations thereof, and the like. In addition, stabilizers, emulsifiers and other additives may be present in the explosive mixture of the booster charge. In one preferred embodiment, the energetic composition includes one or more inert materials with the inert materials preferably forming inert nanotubular structures.

Manufacture of the energetic composition of the present invention, as a burn rate modifier, may include formation of the nanotubular structures from chemical compositions of inert material, low energy material, high energy material, and combinations thereof, and incorporating the formed nanotubular structures into the energetic composition. Mixtures of the nanotubes containing different chemical compositions are preferably used together within a given propellant to impart particular burn characteristics. Once incorporated into the propellant, the nanotubular structures are able to change the characteristic burn of the solid propellant.

Example 1

Prophetic

Nano-mold forms are made from alumina and oxidized silicon using lithography (see for example, Science, vol. 296, pg. 1997, Jun. 14, 2002, the disclosure of which is hereby incorporated by reference). Melt processible energetic material, as a liquid, is placed onto molds. The molten energetic material is cause to flow into the holes in the molds. As taught in the above-referenced Science article, a channel forms through the center of the energetic material. The mold is dissolved away using potassium hydroxide (KOH) solution. The formed nanotubes of the energetic material has a wall thickness of a few tens of nanometers.

Example 2

Prophetic

The process of Example 1 is used with energetic materials of RDX dissolved in a solvent being used.

Example 3

Prophetic

The process of Example 1 is used with energetic materials of CL-20 dissolved in a solvent being used.

Example 4

Prophetic

The propellant containing the energetic nanotubes of Example 1 is extruded to align the nanotubes along the direction of burn. The process of extrusion causes the nanotubes within the propellant to be preferentially aligned along the direction of extrusion. The alignment of the nanotubes will result in an increase in the propellant burn rate along the direction of extrusion. In a similar manner, molded propellant grains can contain nanotubes aligned along the preferred direction(s) of burn by using advanced molding techniques.

The foregoing summary, description, and examples of the present invention are not intended to be limiting, but are only exemplary of the inventive features which are defined in the claims.

What is claimed is:

1. A process for producing a burn rate modifier, comprising:

providing a chemical composition from an energetic material;

forming nanotubular structures from said chemical composition, wherein said forming comprises composing at least one of said nanotubular structures from said energetic material where said energetic material is a melt processible energetic material; and, incorporating said nanotubular structures into an energetic composition for alignment of the nanotubular structures with a direction of an increased burn rate of the energetic composition.

2. The process of claim 1, further comprising forming the energetic composition into a solid propellant.

3. The process of claim 1, wherein said energetic composition is a burn rate modifier product.

4. The process of claim 3, wherein the nanotubular structures increases the Isp of the energetic composition.

5. The process of claim 1, wherein the chemical composition further comprises at least one of temperature lowering plasticizers and temperature lowering solvents.

6. The process of claim 1, wherein said forming further comprises said melt processible energetic material is melted and molded to produce said nanotubular structures.

* * * * *